US005707591A

United States Patent [19]

Semedard et al.

[11] Patent Number: 5,707,591

[45] Date of Patent: Jan. 13, 1998

[54] CIRCULATING FLUIDIZED BED REACTOR HAVING EXTENSIONS TO ITS HEAT EXCHANGE AREA

[75] Inventors: Jean-Claude Semedard, Paris; Pierre Gauville, Verrieres le Buisson; Pascale Amadieu, Velizy; Jean Aubry, Le Plessis Robinson; Jean-Xavier Morin, Neuville Aux Bois, all of France

[73] Assignee: GEC Alsthom Stein Industrie, Velizy-Villacoublay, France

[21] Appl. No.: 723,386

[22] Filed: Sep. 30, 1996

Related U.S. Application Data

[63] Continuation of Ser. No. 337,522, Nov. 9, 1994, abandoned.

[30] Foreign Application Priority Data

Nov. 10, 1993 [FR] France ..... 93 13476

[51] Int. Cl.[6] ..... F27B 15/14

[52] U.S. Cl. ..... 422/146; 422/200; 165/53; 165/55

[58] Field of Search ..... 422/141, 142, 422/146, 193, 200, 201; 168/53, 55, 142

[56] References Cited

U.S. PATENT DOCUMENTS

| | | | |
|---|---|---|---|
| 4,165,717 | 8/1979 | Reh et al. | 122/40 |
| 4,176,710 | 12/1979 | Gansauge et al. | 422/146 |
| 4,442,796 | 4/1984 | Strohmeyer, Jr. | 122/4 D |
| 4,649,867 | 3/1987 | Cordier et al. | 48/92 |
| 5,316,736 | 5/1994 | Vidal et al. | 422/141 |

FOREIGN PATENT DOCUMENTS

| | | |
|---|---|---|
| 0272410A2 | 6/1988 | European Pat. Off. . |
| 1048832 | 11/1966 | United Kingdom . |

*Primary Examiner*—Christopher Kim

*Attorney, Agent, or Firm*—Sughrue, Mion, Zinn, Macpeak & Seas, PLLC

[57] ABSTRACT

A circulating fluidized bed reactor comprising a top zone surrounded by walls provided with heat exchange tubes, the heat exchange tubes being interconnected by fins, and a bottom zone provided with a fluidization grid, a primary air injection device beneath the grid, a secondary air injection device above the grid, and a fuel injection device, the walls surrounding the bottom zone being provided with heat exchange tubes. The walls of the zones are provided with vertical heat exchange panels referred to as "extensions" that extend perpendicularly to the walls of the zones, that are made up of tubes inside the reactor, that are of horizontal width lying in the range 150 mm to 500 mm, and that are spaced apart from one another via a distance lying in the range 1.5 times to 4 times their width, the width being defined as the distance between the inside faces of the fins of the walls and the most distant generator lines of the most distant tubes of the extensions.

11 Claims, 4 Drawing Sheets

CIRCULATING FLUIDIZED BED REACTOR HAVING EXTENSIONS TO ITS HEAT EXCHANGE AREA

This is a continuation of application No. 08/337,522 filed Nov. 9, 1994 now abandoned.

FIELD OF THE INVENTION

The present invention relates to a circulating fluidized bed reactor having extensions to its heat exchange area.

Circulating fluidized bed reactors are commonly used in fossil fuel power stations and at ever-increasing power levels.

More precisely, the invention relates to a circulating fluidized bed reactor comprising a top zone surrounded by walls provided with heat exchange tubes, and a bottom zone provided with a fluidizing grid, primary air injection means beneath the grid, secondary air injection means above the gird, and fuel injection means, the walls surrounding said bottom zone being provided with heat exchange tubes.

BACKGROUND OF THE INVENTION

It is known that in order to obtain effective removal of sulfur from the flue gases, it is necessary for the temperature of the reactor to be kept constant at a value close to 850° C. An effective technique consists in installing heat exchange panels in the reactor and, for the purpose of maintaining said temperature, in making use either of adjustments in the concentration of solids by adjusting the flow rates of primary and secondary air, or of variations in the rate at which combustion gases are recycled, or else of cooling the recycled solids in dense fluidized beds external to the reactor.

Various dispositions of such panels are known:

- L-shaped vertical panels suspended in the top of the reactor for superheating purposes;
- horizontal panels in the top portion passing right through the reactor for superheating purposes;
- U-shaped panels suspended from the ceiling of the reactor for superheating purposes;
- very wide panels fixed perpendicularly to the wall of the reactor and conveying an emulsion, such as those of the fluidized bed reactor described in U.S. Pat. No. 4,442,796; and
- reactor separating panels disposed over a fraction of its height and optionally having communicating openings, as described in U.S. Pat. No. 4,165,717.

Thus, in the prior art, as the power of the installation increases, it has been deemed necessary to extend the installation of such heat exchange panels both with respect to area and towards ever higher levels within the reactor, thereby giving rise to risks of vibration, to increased risks of erosion in the bottom portions of said panels where they are subjected to flows of solid particles, and to risks of the panels and the walls becoming distorted because of differential expansion which becomes worse with ever-increasing panel heights.

OBJECTS AND SUMMARY OF THE INVENTION

The present invention solves these problems of erosion and of distortion by going against the technical prejudice whereby effort is directed towards increasing the area of the heat exchange panels of the reactor.

To do this, according to the invention, at least one wall of at least one of said top and bottom zones is provided with vertical heat exchange panels referred to as "extensions" that extend perpendicularly to the wall and that are made up of heat exchange tubes inside the reactor, the horizontal width of the extensions lying in the range 150 mm to 500 mm, and the extensions being spaced apart from one another by a distance lying in the range 1.5 times to 4 times their width.

The extensions are not very wide, and as a result they avoid warping the walls of the reactor because of the mechanical forces generated by differential expansion, and said extensions are situated in the down-flowing layer of solids, as described in greater detail below.

When the heat exchange tubes of the walls are interconnected by fins, said width is defined as the distance between the inside faces of the fins of the walls and the most distant generator lines of the most distant tubes in respective ones of the extensions.

In a first method of fixing, the extensions are welded continuously to the wall of the zone.

In a second method of fixing, the extensions are offset from the wall by a distance of less than 60 mm, said distance being the distance between the inside faces of the fins of the walls and the nearest extension tube generator lines, the extensions being supported, at least by their top portions.

Advantageously, the extensions are distributed around the inside perimeter of the reactor.

The extensions may be situated along the full height of the reactor.

In a preferred embodiment, the extensions are disposed over the entire height of the wall of the top zone.

In which case, the extensions run from the ceiling of the reactor and their bottom ends pass through the sloping walls of the bottom zone. Compared with the prior art, in which unprotected horizontal portions are subjected to the flow of particles and are thus eroded, all problems of erosion are thereby eliminated.

In order to increase mechanical strength, the extensions of the tubes may include auxiliary tubes connected to the free ends of the extensions, and secured outside the plane of symmetry of the extensions.

In a particular variant embodiment, in which the reactor includes at least one internal dense fluidized bed in communication with the inside of the reactor via its top portion, the bed receiving solid matter falling down the walls of the top zone, and returning at least a fraction of the solid matter by allowing it to overflow towards the bottom zone all along and over an overflow wall, said internal bed being fitted with heat exchange tubes having their bottom portions connected to a feed inlet and having their top portions connected to an outlet, the tubes of the extensions are used as outlet tubes for the tubes fitted to the internal bed.

The invention is described in greater detail below with reference to the figures that merely show a preferred embodiment.

DETAILED DESCRIPTION OF THE PREFERRED EMBODIMENTS

Figure 1:
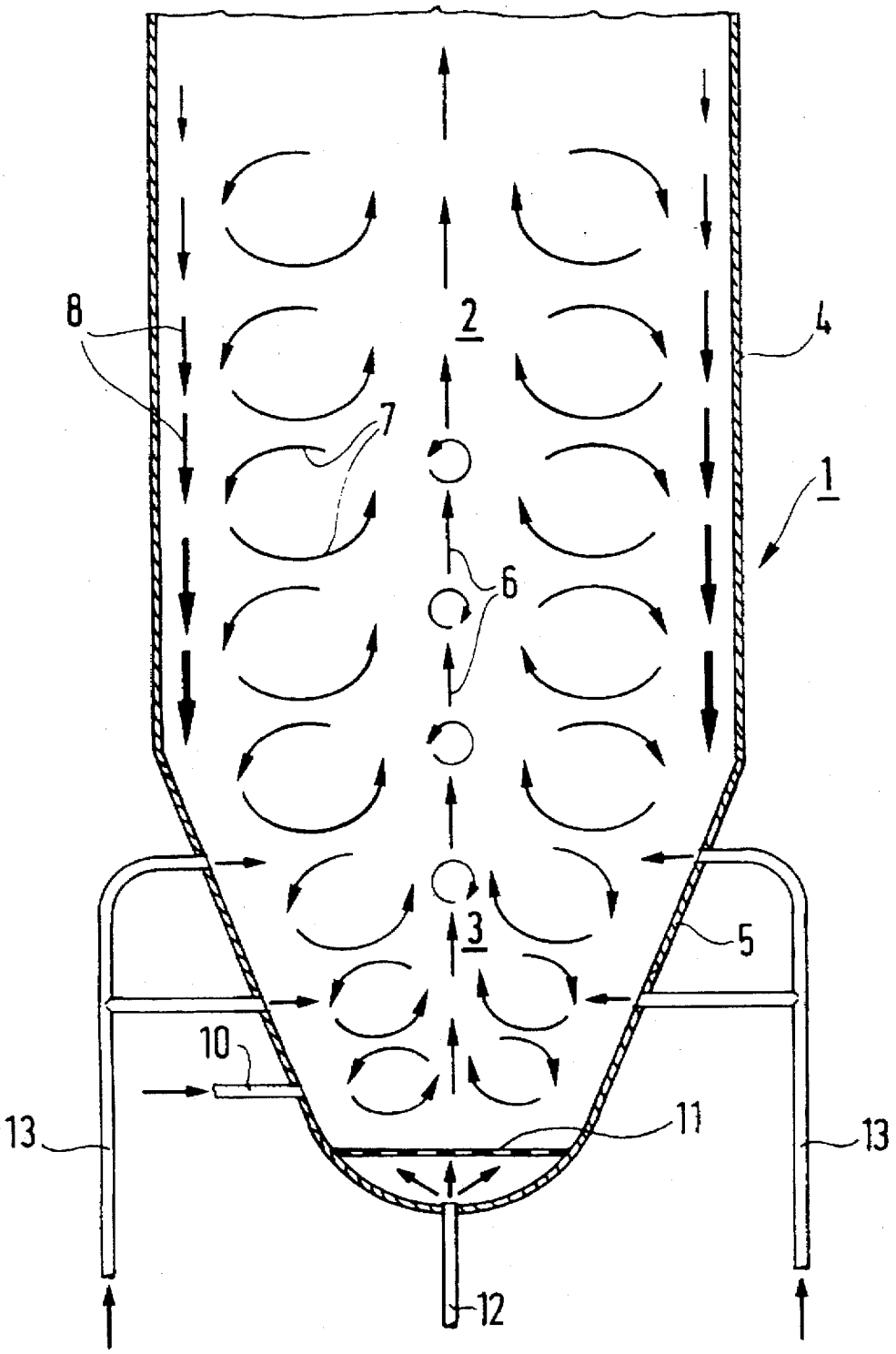
FIG. 1 is a vertical section view through a circulating fluidized bed reactor.

FIG. 1 corresponds to conventional operation of a circulating bed reactor 1, comprising a bottom zone 3 of upwardly flaring section and a top zone 2 of constant rectangular section. The bottom zone 3 is provided with a fluidizing grid 11, primary air injection means 12 beneath the grid 11, secondary air injection means 13 above the grid 11, and fuel injection means 10. The walls 5 surrounding said bottom zone 3 are provided with heat exchange tubes. The top zone 2 is likewise surrounded by walls 4 provided with heat exchange tubes.

Solid particles move upwards above the grid 11 travelling towards the top of the reactor along arrows 6. These particles tend to move away towards the walls 4 and 5 and to drop back downwards. Nevertheless, a fraction of the finest particles is entrained back in an upward direction, following turbulent motion such as 7. The remaining particles move closer to the walls 4 and 5, and then flow downwards along them as shown by arrows 8, where they build up to form a dense layer of solids.

Measurements performed on such dense layers of solids along such walls show that its thickness varies up the height of the reactor and depending on the loading of the reactor, with said thickness lying substantially in the range 50 mm to 500 mm.

The invention consists in providing narrow extensions to the heat exchange areas that are engaged in said layer of downwardly moving solids, thereby improving the heat exchange coefficients of the walls of the reactor.

In a conventional reactor without the extensions of the invention, for an overall coefficient of approximately 180 $W/m^2K$, a portion of 100 $W/m^2K$ is obtained by radiation and another portion 80 $W/m^2K$ is obtained by convection relating to the solid particles. The invention serves to considerably increase the portion relating to convection, thereby also increasing the overall coefficient.

The extensions of the invention give rise to an increase in the thickness of the layer of solids along the walls by a phenomenon that may be referred to as a "wedging" effect. A wedge of extra thickness in the layer is created because of the rounded shape that is naturally taken up by the layer of solids at this position. Because of the extensions of the invention, a large number of wedges is created, and the thickness of the solids is correspondingly increased. The mean concentration of solids is therefore artificially increased in the cavity defined between two extensions when compared with a simple plane wall, thereby improving the heat exchange coefficient.

In addition, extensions of the invention provide two heat exchange faces, thereby increasing the overall heat exchange area of the reactor, and thus also improving the heat exchange coefficient.

Figure 2:
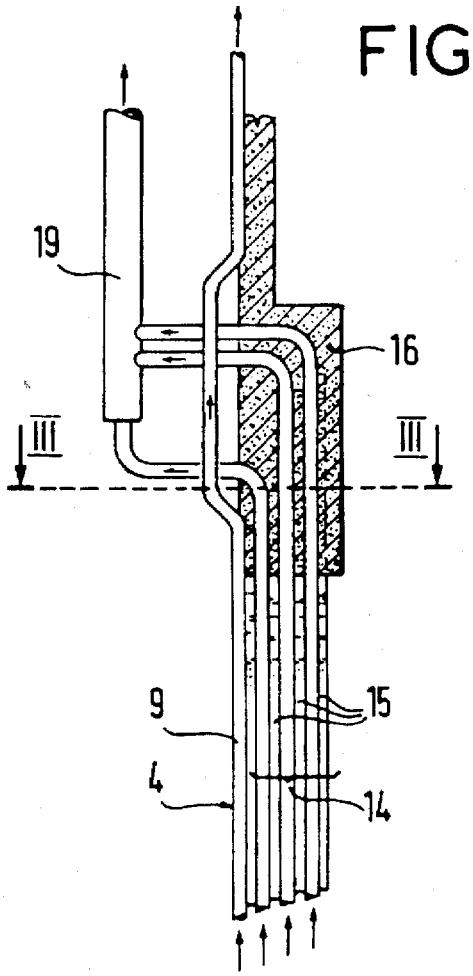
FIG. 2 is a fragmentary vertical section view through a wall of the reactor of the invention.
Figure 3A:
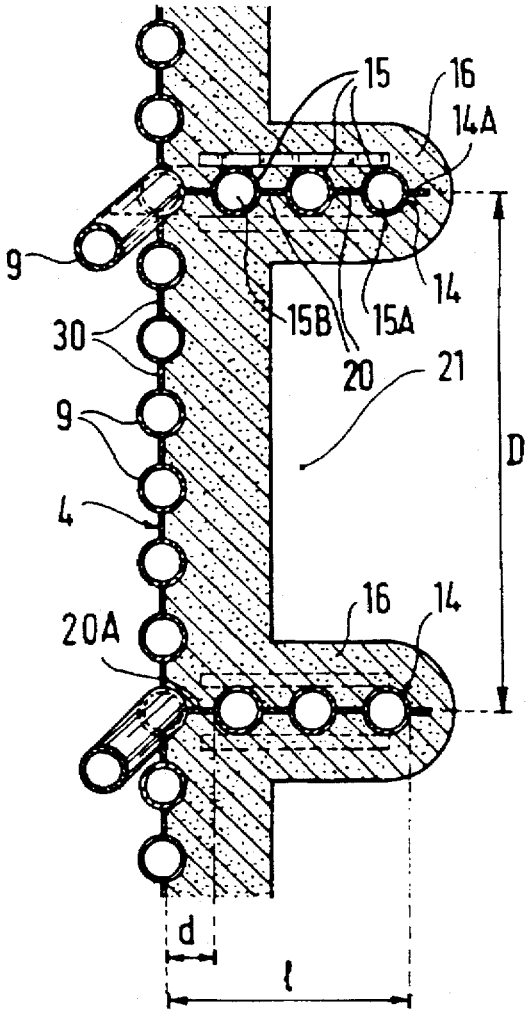
FIG. 3A is a section view on III—III of FIG. 2.

FIGS. 2 and 3A show an embodiment of an extension of the invention.

The extensions are preferably implemented in conventional manner, i.e. they are constituted by tubes which are interconnected by plane fins. Extensions 14 perpendicular to the wall 4 and inside the reactor are added to the wall 4 already provided with longitudinal heat exchange tubes 9. The extension 14 shown comprises three vertical heat exchange tubes 15 whose top and bottom portions are embedded in and protected by layers of concrete 16. The tubes 15, and also the tubes 9, are connected to one another by plane welded fins 20. The tubes 15 are fed with a water-steam emulsion at their bottom ends via a feed inlet, and at their top ends they are connected to an outlet 19. In order to avoid differential expansion, the tubes 15 are fed with an emulsion.

According to the invention, the extensions 14 extending perpendicularly from at least one wall 4, 5 in at least one of the zones 2, 3 and made up of tubes 15 inside the reactor are of a horizontal width l lying in the range 150 mm to 500 mm, and they are spaced apart from one another at intervals D lying in the range 1.5 times to 4 times their width, where the width is defined as being the distance between the inside face of a fin 30 of the wall 4, 5, and the most distant generator line of the most distant tubes 15A of the extensions.

The extensions may be welded continuously to the wall 4, 5 of the zones 2, 3 as shown in FIG. 2, or they may be remote from the walls 4, 5, being offset therefrom by a distance d that is not greater than 60 mm, which distance is the distance between the inside faces of the fins 30 of the walls and the nearest generator lines of the tubes 15B, which amounts to eliminating the first fin 20A of each extension and supporting the extensions from the top and possibly also from the bottom.

Figure 3B:
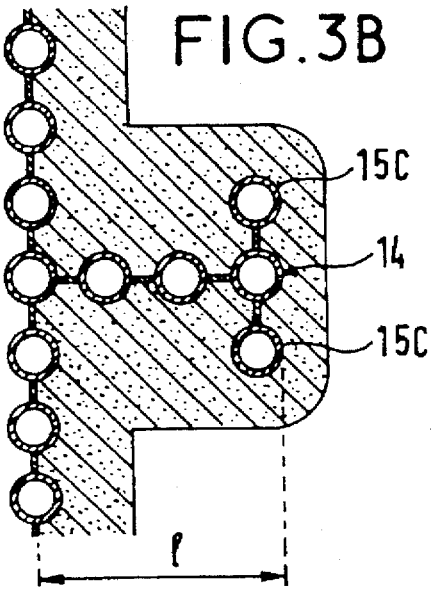
FIG. 3B is an analogous section view of a variant.

The extensions 14 of the tubes 15 may include auxiliary tubes 15C connected to the free ends 14A of the extensions 14, fixed outside the plane of symmetry of each extension 14 so as to reinforce the mechanical strength of the extensions 14, e.g. as shown in FIG. 3B.

Figure 4A:
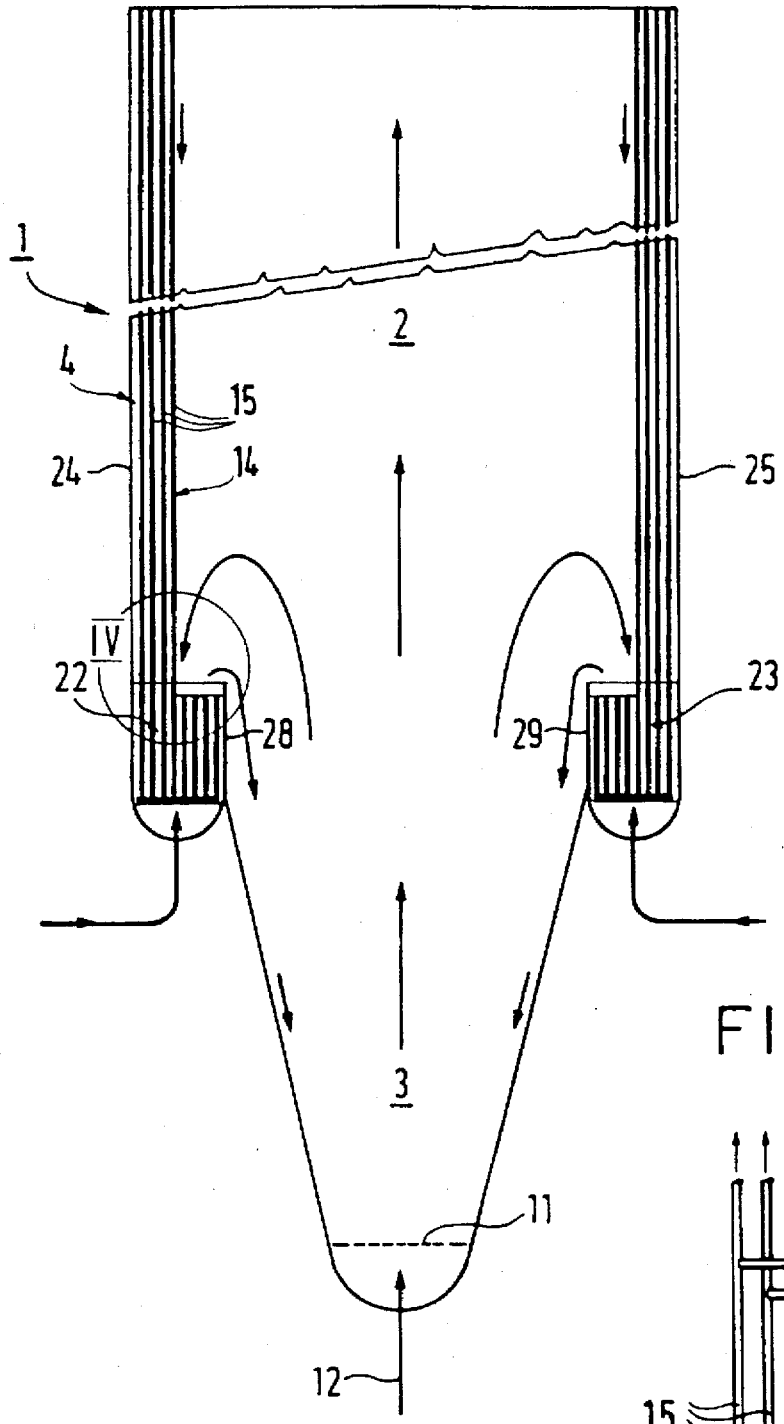
FIG. 4A is a vertical section view through a reactor of the invention constituting a variant embodiment.

FIG. 4A shows a particularly advantageous disposition of extensions of the present invention.

Figure 4B:
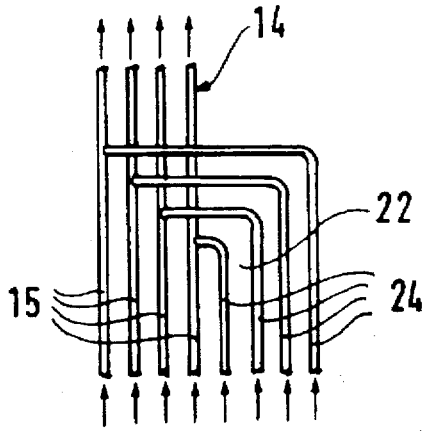
FIG. 4B is a detail view of a portion IV.

It is known, e.g. from French patent application No. 2 690 512 filed by the present Applicant, to fit a reactor with internal dense fluidized beds 22, 23. These dense fluidized beds 22, 23 are in communication with the inside of the reactor via their top portions which receive solids falling down the walls 4 of the top zone 2 and which return at least a fraction of the solids by allowing them to overflow towards the bottom zone 3 along and over overflow walls 28 and 29. The internal beds 22 and 23 have their walls fitted with heat exchange tubes connected at their bottom ends to a feed and at their top ends to an outlet. These beds may optionally also include immersed heat exchange tubes. Advantageously, the tubes of the extensions 14 of the invention may be used as outlet tubes for the tubes constituting the walls of said beds 22 and 23, and optionally for the tubes immersed in said beds 22 and 23, thereby avoiding any need for passages through the wall 4 with the resulting risk of erosion, the outlet tubes being vertical rather than horizontal. FIG. 4B shows one example of the outlet coupling of the heat exchange tubes 24 fitted to the internal bed 22 and of the tubes 15 constituting an extension 14.

In this embodiment, each internal bed 22, 23 is installed between at least two extensions 14 and it gives rise to another effect and technical advantage of the invention. The spaces between the extensions 14 form channels or paths 21 down which solids fall towards the beds 22, 23, and give rise to an increase in the flow rate of solids going down towards said beds. The internal beds 22 and 23 are connected to external heat exchangers, and they are fed with a higher flow rate of solids, thereby improving heat exchange and making it possible to reduce the size of the external heat exchangers considerably.

Figure 5A:
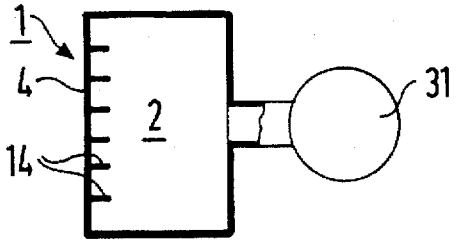
FIGS. 5, 6, and 7 are fragmentary sections through various organizations of reactors of the invention.
Figure 5B:
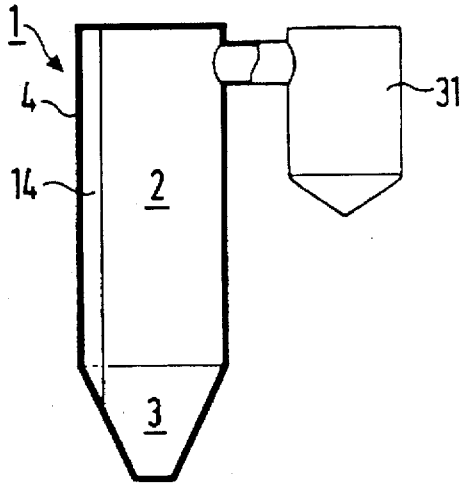
Figure 6A:
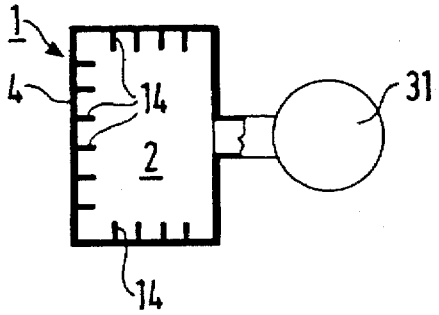
Figure 6B:
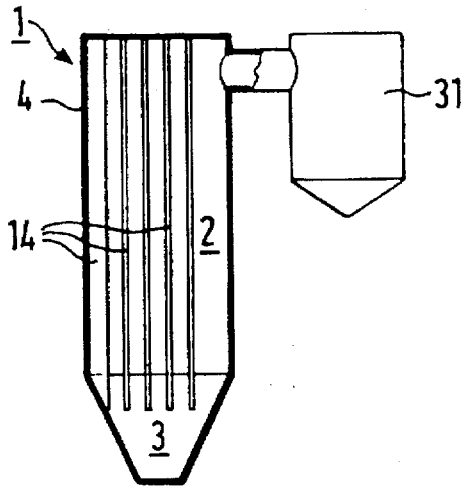
Figure 7A:
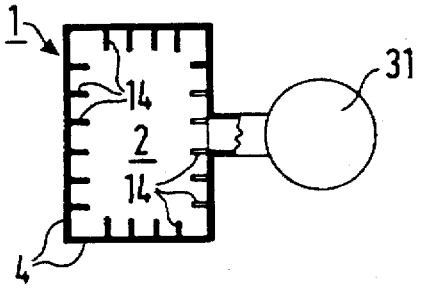
Figure 7B:
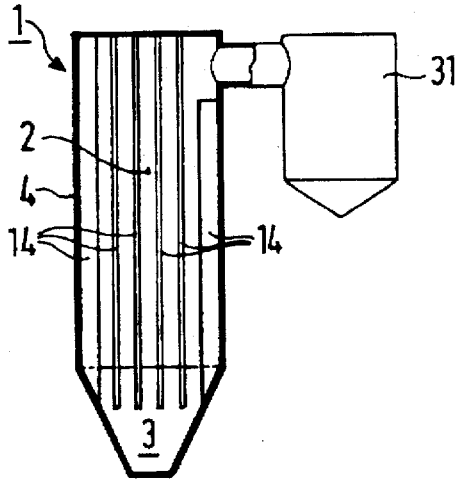

FIGS. 5 to 7 show various possible organizations of the extensions 14. The reactor is provided in conventional manner with a cyclone 31. The extensions 14 fitted with tubes 15 extend along the full height of the wall 14 of the top portion 2 of the reactor, and they cover one or more sides of said zone 2. In this case, the extensions run from the ceiling the reactor and their bottom ends pass through the sloping walls 5 of the bottom portion 3. As a result, compared with the prior art, all problems of erosion are eliminated since no uncovered horizontal portion is exposed to the flow of particles.

We claim:

1. A circulating fluidized bed reactor comprising a top zone surrounded by walls defining a top portion and provided with heat exchange tubes, and a bottom zone provided with a fluidizing grid, a primary air injector beneath the grid, a secondary air injector above the grid, and a fuel injector above the grid, the walls surrounding said bottom zone being provided with heat exchange tubes, wherein at least one wall of at least one of said zones is provided with vertical heat exchange panels comprising extensions that extend perpendicularly to the wall and that are made up of a plurality of heat exchange tubes inside the reactor, the horizontal width of the extensions lying in the range of 150 mm to 500 mm, and the extensions being spaced apart from one another by a distance lying in the range of 1.5 times to 4 times their width, wherein solid particles move upward above the grid and travel toward the top portion of the reactor, and at least a portion of said solid particles moves proximate to the walls of the top and bottom zones and then flows downward along the walls thereby forming a layer of solids which travels down along the walls and along the extensions, and further wherein the horizontal width of the extensions and the distance by which the extensions are spaced apart from one another are chosen based on a thickness of the layer of solids.

2. The reactor according to claim 1, in which the heat exchange tubes of the walls are interconnected by fins, and in which the heat exchange tubes of each extension include an innermost extension tube defining a nearest point and an outermost extension tube defining a most distant point, wherein said width is defined as the distance between the inside faces of the fins of the walls, and the most distant point of the outermost tube in each of the extensions.

3. The reactor according to claim 2, wherein the extensions are welded continuously to the wall of the at least one of said zones.

4. The reactor according to claim 2, wherein the extensions are offset from the wall by a distance of less than 60 mm, said distance being the distance between the inside faces of the fins of the walls and the nearest point of the innermost extension tube, the extensions being supported at least by their top portions.

5. The reactor according to claim 1, wherein the extensions are distributed around the inside perimeter of the reactor.

6. The reactor according to claim 1, wherein the extensions are situated along the full height of the reactor.

7. The reactor according to claim 1, wherein the extensions are disposed over the entire height of the wall of the top zone.

8. The reactor according to claim 1, wherein each of the extensions of tubes, which extend perpendicularly to the wall in a plane, includes auxiliary tubes connected to the free end thereof, said auxiliary tubes being fixed outside of the plane of the corresponding extension.

9. The reactor according to claim 1, and including at least one internal dense fluidized bed in communication with the inside of the reactor via its top portion, the bed receiving solid matter falling down the walls of the top zone, and returning at least a fraction of the solid matter by allowing it to overflow towards the bottom zone all along and over an overflow wall, said internal bed being fitted with heat exchange tubes having their bottom portions connected to a feed inlet and having their top portions connected to an outlet, wherein the tubes of the extensions are used as outlet tubes for the tubes fitted to the internal bed.

10. A circulating fluidized bed reactor comprising a top zone surrounded by walls defining a top portion and provided with heat exchange tubes, and a bottom zone provided with a fluidizing grid, a primary air injector beneath the grid, a secondary air injector above the grid, and a fuel injector above the grid, the walls surrounding said bottom zone being provided with heat exchange tubes, wherein at least one wall of at least one of said zones is provided with vertical heat exchange panels comprising extensions, each of said extensions comprising a plurality of substantially vertical heat exchange extension tubes which are aligned proximate to one another so as to extend perpendicularly with respect to the wall, at least one of a top portion and a bottom portion of said extension tubes being embedded in a protective concrete layer, the horizontal width of the extensions lying in the range of 150 mm to 500 mm, and the extensions being spaced apart from one another by a distance lying in the range of 1.5 times to 4 times their width, wherein solid particles move upward above the grid and travel toward the top portion of the reactor, and at least a portion of said solid particles moves proximate to the walls of the top and bottom zones and then flows downward along the walls thereby forming a layer of solids which travels down along the walls and along the extensions, and further wherein the horizontal width of the extensions and the distance by which the extensions are spaced apart from one another are chosen based on a thickness of the layer of solids.

11. The reactor according to claim 10, wherein said extension tubes are connected to one another by plane fins.

* * * * *